US006224277B1

(12) United States Patent
Dolce et al.

(10) Patent No.: US 6,224,277 B1
(45) Date of Patent: May 1, 2001

(54) INK RIBBON WITH ADHESIVE FOR ATTACHING END OF RIBBON TO SUPPLY ROLL

(75) Inventors: Anthony C. Dolce, Lockport; Robert S. Eaton, Buffalo; Joel D. Neri, Youngstown, all of NY (US)

(73) Assignee: International Imaging Materials, Inc., Amherst, NY (US)

( * ) Notice: Subject to any disclaimer, the term of this patent is extended or adjusted under 35 U.S.C. 154(b) by 0 days.

(21) Appl. No.: 09/354,228

(22) Filed: Jul. 16, 1999

(51) Int. Cl.[7] ..... B41J 31/05

(52) U.S. Cl. ..... 400/238; 400/207; 400/208; 400/208.1; 400/237; 242/160.1; 242/160.4; 206/393

(58) Field of Search ..... 400/237, 238, 400/207, 208, 208.1, 206, 242, 243, 246; 242/160.1, 160.4; 206/393

(56) References Cited

U.S. PATENT DOCUMENTS

| | | | | |
|---|---|---|---|---|
| 1,850,718 | | 3/1932 | Henderson | 206/393 |
| 2,732,063 | | 1/1956 | Dedek et al. | 206/410 |
| 2,912,102 | | 11/1959 | Scott | 206/393 |
| 3,108,675 | * | 10/1963 | Rooney | 400/238 |
| 3,286,808 | * | 11/1966 | Arena et al. | 400/238 |
| 3,460,671 | | 8/1969 | Harm | 206/391 |
| 3,476,238 | | 11/1969 | Wright et al. | 206/393 |
| 4,475,830 | * | 10/1984 | Schaefer | 400/238 |
| 4,809,018 | * | 2/1989 | Nakamura et al. | 400/206 |
| 5,269,612 | * | 12/1993 | Shimoha et al. | 400/238 |
| 5,415,486 | | 5/1995 | Wouters et al. | 400/692 |
| 5,492,221 | | 2/1996 | Light et al. | 400/692 |
| 5,536,094 | | 7/1996 | Kondo | 400/247 |
| 5,547,298 | | 8/1996 | Wouters et al. | 400/692 |
| 5,839,839 | | 11/1998 | Brot et al. | 400/242 |

FOREIGN PATENT DOCUMENTS

| | | | | |
|---|---|---|---|---|
| 59-54589 | * | 3/1984 | (JP) | 400/238 |
| 61-244582 | * | 10/1986 | (JP) | 400/238 |
| 6-115229 | * | 4/1994 | (JP) | 400/238 |
| 7-314868 | * | 12/1995 | (JP) . | |

* cited by examiner

*Primary Examiner*—Daniel J. Colilla
(74) *Attorney, Agent, or Firm*—Joseph J. Grass

(57) ABSTRACT

Disclosed are various embodiments of packaging for a roll of a web which is attached to a take-up core. The web is arranged so that it packages the roll together with the core, ready for shipment without the need for additional packaging. The web can include an ink ribbon and a leader connected to the ink ribbon.

27 Claims, 12 Drawing Sheets

INK RIBBON WITH ADHESIVE FOR ATTACHING END OF RIBBON TO SUPPLY ROLL

BACKGROUND OF THE INVENTION

1. Field of the Invention

This invention relates to the art of packages and packaging and to methods of making and using packages.

2. Brief Description of the Prior Art

The following U.S. patents are made of record: U.S. Pat. Nos. 1,850,718; 2,732,063; 2,912,102; 3,460,671; 3,476,238; 5,415,486; 5,492,221; 5,536,094; 5,547,298; and 5,839,839.

It is known to provide an ink ribbon package including a web having an ink ribbon portion wound onto and adhesively adhered to a supply core and having an outwardly extending leader portion. The web is wound into a roll and the take-up core is adhesively attached to the end of the leader portion. One or more strips of pressure sensitive tape, separate from the web, extend generally longitudinally or lengthwise of the web beyond the leader portion and are adhered to the outside of the take-up core and/or the leader portion and to the outer surface of the roll to hold the roll and the take-up core together. The free end portions of the pressure sensitive adhesive tapes can be folded onto themselves to provide manually graspable tabs. The pressure sensitive tapes can be grasped by their tabs and peeled from the outer surface of the roll to unwrap the take-up core with respect to the roll. During the manufacturing process, the leader portion is connected to the ink ribbon portion using a commercially available leader-trailer bed and thereafter the ink ribbon portion and the leader portion are rewound in a commercially available rewinder.

SUMMARY OF THE INVENTION

It is a feature of the invention to provide improved packages and improved methods of making same, wherein the packages can be manufactured on conventional manufacturing equipment.

It is another feature of the invention to provide improved packages and improved methods of making same, wherein the web itself serves not only as the product to be used by the user, but the web also serves as the packaging material, without the need for additional packaging materials such as a shrink-wrap plastic outer wrapper, a carton or the like.

It is another feature of the invention to provide improved packages wherein a web roll is attached to a take-up core and wherein the web itself extends beyond the outside of the roll and serves as the packaging or wrapping.

It is another feature of the invention to provide an improved ink ribbon roll package which is economical to manufacture and is easy for the user to unwrap and use.

It is still another feature of the invention to provide an improved package for a web roll with an outer outwardly extending portion, wherein a take-up core is permanently transversely attached to the outer portion of the web and the web is removably attached to itself at a transversely extending stripe of adhesive.

Other features will be apparent to those skilled in the art upon reference to the following description and the accompanying drawings.

BRIEF DESCRIPTION OF THE DIAGRAMMATIC DRAWINGS

DETAILED DESCRIPTION OF THE PREFERRED EMBODIMENTS

Figure 1:
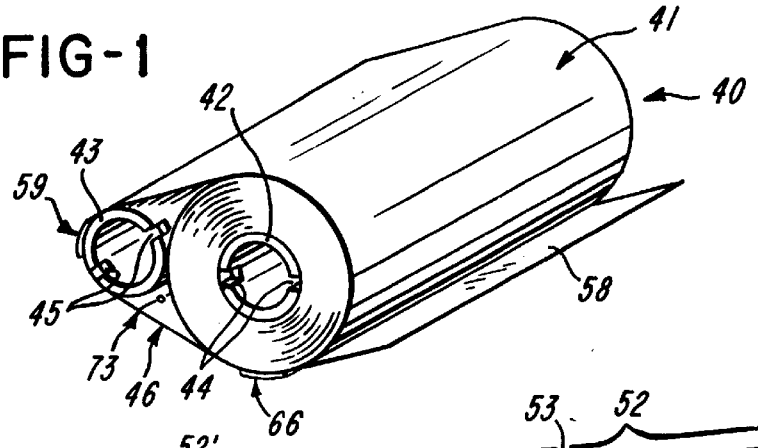
FIG. 1 is a perspective view of a package of the embodiment of FIGS. 1 through 8 including a web in roll form and a take-up core, wherein the web is also used as the wrapper or packaging.

With reference to the embodiment of FIGS. 1 through 8, and initially to FIG. 1, there is shown a package generally indicated at 40 including a roll 41 having a supply core 42 and a take-up core 43. The core 42 is shown to have notches 44, and the core 43 is shown to have notches 45. The notches 44 and 45 are typically used in a printer for advancing a web generally indicated at 46. Although notches 44 and 45 are illustrated, a greater or lesser number of notches, or no notches at all can be provided depending on the machine with which the cores are to be used.

Figure 2:
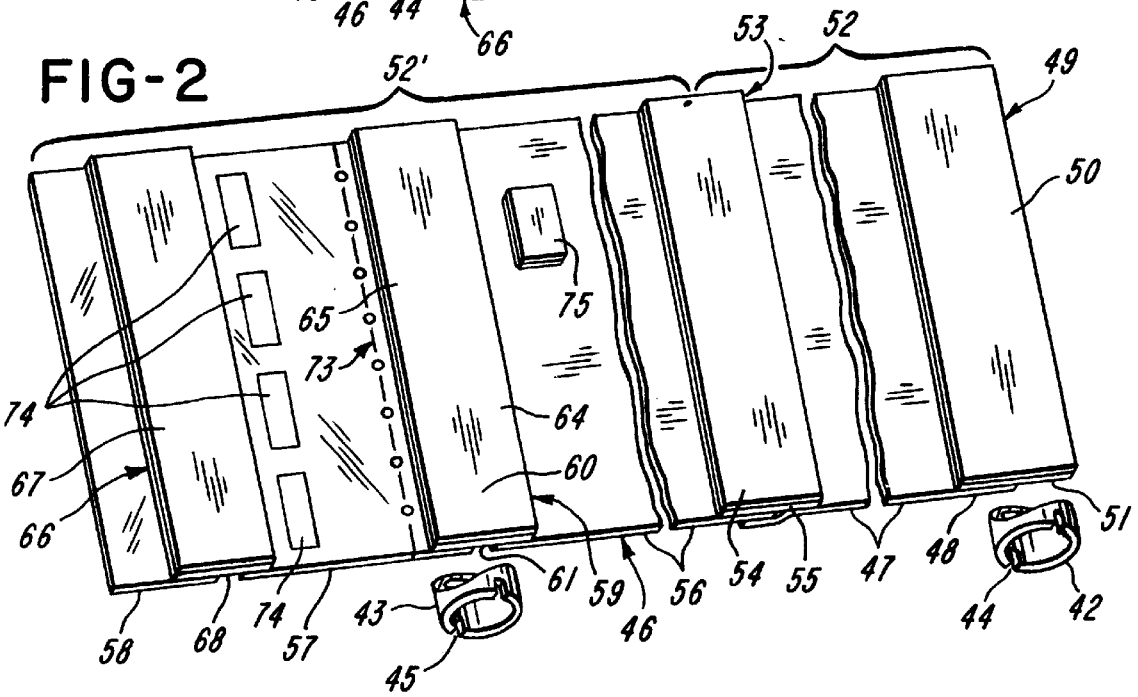
FIG. 2 is a developed, exploded, perspective view showing fragmentary portions of the web and the supply and take-up cores.
Figure 3:
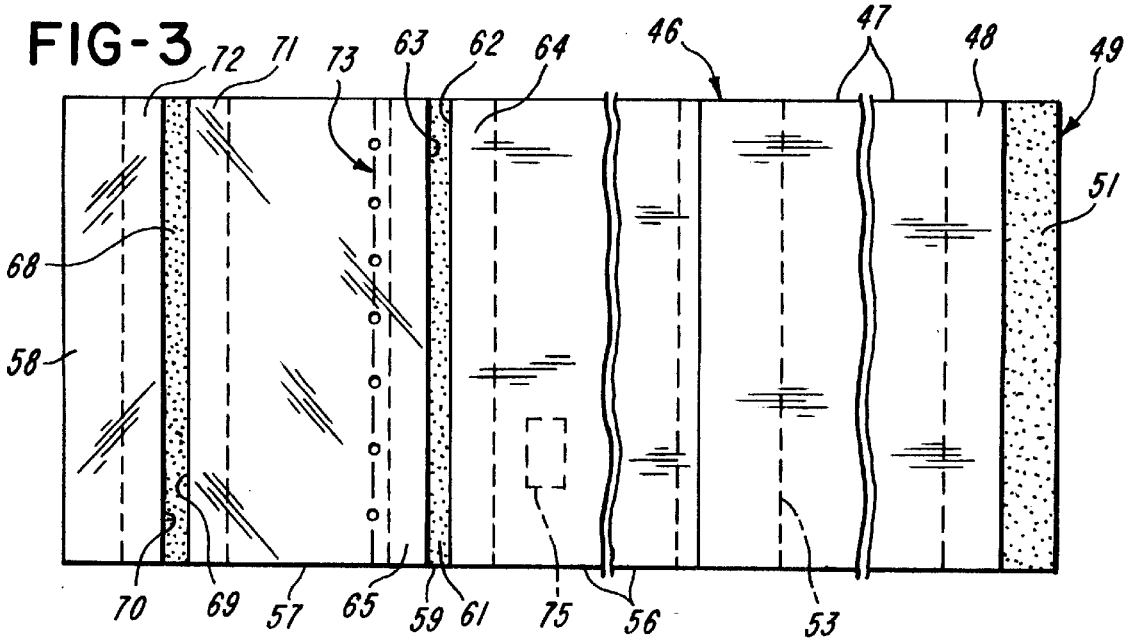
FIG. 3 is a bottom plan view of the web shown in detail in FIG. 2.
Figure 4:
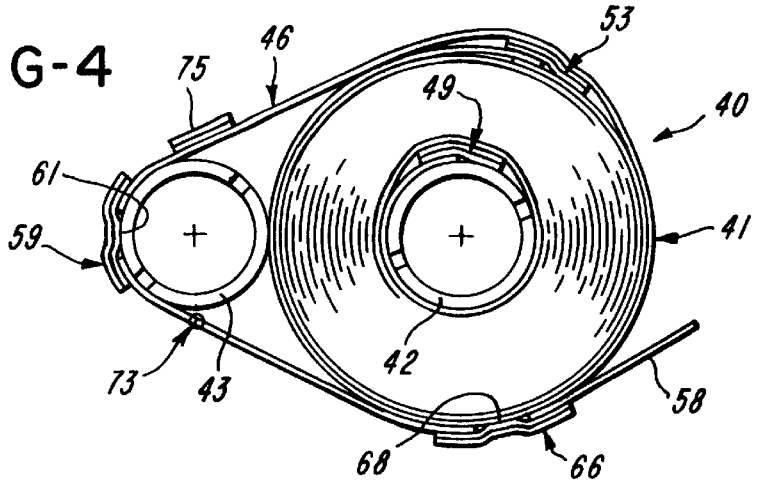
FIG. 4 is a side elevational view of the package.
Figure 5:
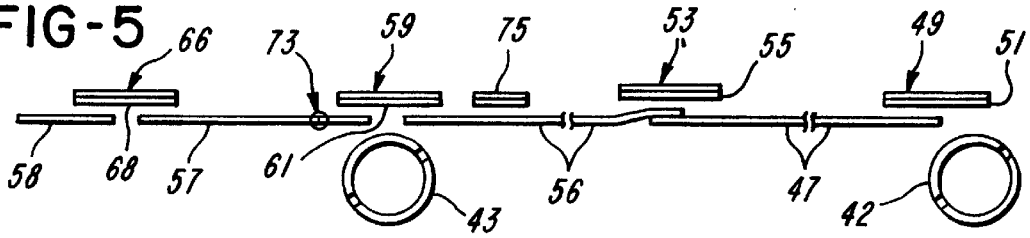
FIG. 5 is a developed, exploded, fragmentary, side elevational view of the web and the supply and take-up cores.

FIG. 2 shows the web 46 as including a main web portion 47 which occupies most of the length of the web 46. In this and in the other embodiments, the main web portion 47 has a coating and in particular a coating of ink and thus comprises an ink ribbon which includes a thin coating or layer of ink on a web of plastics film. The web 47 has a marginal end 48 to which a strip of pressure sensitive adhesive tape 49 is adhesively secured. The tape 49 is comprised of a flexible plastics film 50 with a uniform coating of adhesive 51. The adhesive 51 adheres the tape 49 to the marginal end 48 and adheres the web 46 to the core 42. The tape 49 overlaps the marginal end 48 and presents an exposed transversely extending adhesive stripe to the outer surface of the supply core 42. The web 46 includes a main web portion 52 which comprises almost all of the web 46, and the web 46 also includes a leader portion 52'. A transversely extending strip of adhesive tape 53 is comprised of a flexible plastics film 54 having a uniform coating of pressure sensitive adhesive 55. The tape 53 is shown connecting the overlapped ink ribbon portion 47 and leader portion 52'. The leader portion 52' is shown to be comprised of flexible leader strips 56, 57 and 58. The leader strips 56 and 57 are shown connected to each other by a transversely extending strip of adhesive tape generally indicated at 59 comprised of flexible plastics film 60 with a uniform coating of pressure sensitive adhesive 61. Terminal first ends 62 and 63 (FIG. 3) of the respective leader strips 56 and 57 are spaced apart and the tape 59 spans the space therebetween and is adhered to respective marginal first ends 64 and 65 of the leader strips 56 and 57. A stripe of the exposed adhesive 61 shown by stippling in FIG. 3 is face-to-face with the take-up core 43 as best shown in FIG. 4. The core 43 is secured to the stripe of adhesive 61 on the tape 59. The adhesive 61 preferably permanently attaches or adheres the take-up core 43 to the leader portion 52'.

A transversely extending strip of adhesive tape generally indicated at 66 connects the leader strips 57 and 58 to each other. The tape 66 has a flexible plastics film 67 and a uniform coating of pressure sensitive adhesive 68. Terminal ends 69 and 70 (FIG. 3) of the respective leader strips 57 and 58 are spaced apart. The tape 66 spans across the space between the terminal ends 69 and 70 and is adhered to marginal ends 71 and 72 of respective leader strips 57 and 58. The leader strip 58 provides a manually graspable tab. While the leader portion 52' is illustrated as being a composite of leader strips 56, 57 and 58 and tapes 59 and 66, the leader portion 52' can be comprised of a single film or leader portion with transverse stripes of adhesive at the locations where the exposed adhesive 61 and 68 exists.

The leader strip 57 is shown to have weakening 73 along a line transversely across the web 46. The weakening 73 is preferably a line of perforations illustrated in FIGS. 2, 3 and 6 of the drawings by broken lines and intervening circles and in FIGS. 4, 5, 7 and 8 by small circles. The flexible adhesive strips 49, 53, 59 and 66 are shown to have considerable thickness for the sake of clarity, but one skilled in the art will recognize that these adhesive strips are thin, by way of example not limitation, on the order of between about 15 to 100 Microns and preferably about 6 Microns thick and the coated web portion or ink ribbon 47 is between about 3 to 15 Microns and preferably about 8 Microns thick.

FIG. 2 shows indicia 74 stating instructions for use, for example the words "Pull Here". A label 75 also bears indicia providing desired information.

In the embodiment of FIGS. 1 through 8, the web 46 is preferably essentially entirely an ink ribbon except for the leader portion 52'. The web 46 is wound into the configuration best shown in FIGS. 1 and 4. The exposed adhesive 68 is shown to hold the web 46 to itself. The adhesive 68 releasably adheres the web 46 to itself. For this purpose the adhesive 68, like the adhesive 61, may be of the permanent type. In that the adhesive 61 adheres to a take-up core 43 which is of paperboard material, the adherence is permanent. In the event the take-up core 43 were to be made of plastics material the aggressiveness of the adhesive should preferably be such as to adhere the web 46 permanently to the core 43. The adhesive 68 may also be of the permanent type, but because the adhesive 68 is adhered to the leader portion 52' comprised of plastics film such as polyethylene film the adhesive 68 is actually removably adhered to the film. If necessary, the adhesive 68 can be less aggressive than the adhesive 61.

The web 46 extends beyond the roll 41 to provide an outwardly extending portion. The web 46 encircles both the roll 41 and the core 43 to provide the packaging or wrapping for the package 40. In order to open or unwrap the package 40, the user manually grasps the tab 58 and pulls in a direction away from the roll 41, thereby releasing the web 46 from itself. Then the user tears the leader strip 57 along the line of weakening 73. The part of the leader portion 52' outwardly of the line of weakening 73 can now be discarded. Now the roll 41 and the take-up core 43 can be inserted into the utilization device, e.g. a printer, in which the web 46 is progressively unwound from the roll 41 and wound onto the take-up core 43. In the illustrated embodiment of FIGS. 1 through 8, the main portion of the web 46 of the roll 41 is an ink ribbon suitable for use in a printer for example a thermal printer. Indeed, almost the entire web 46 is comprised of ink ribbon.

Figure 6:
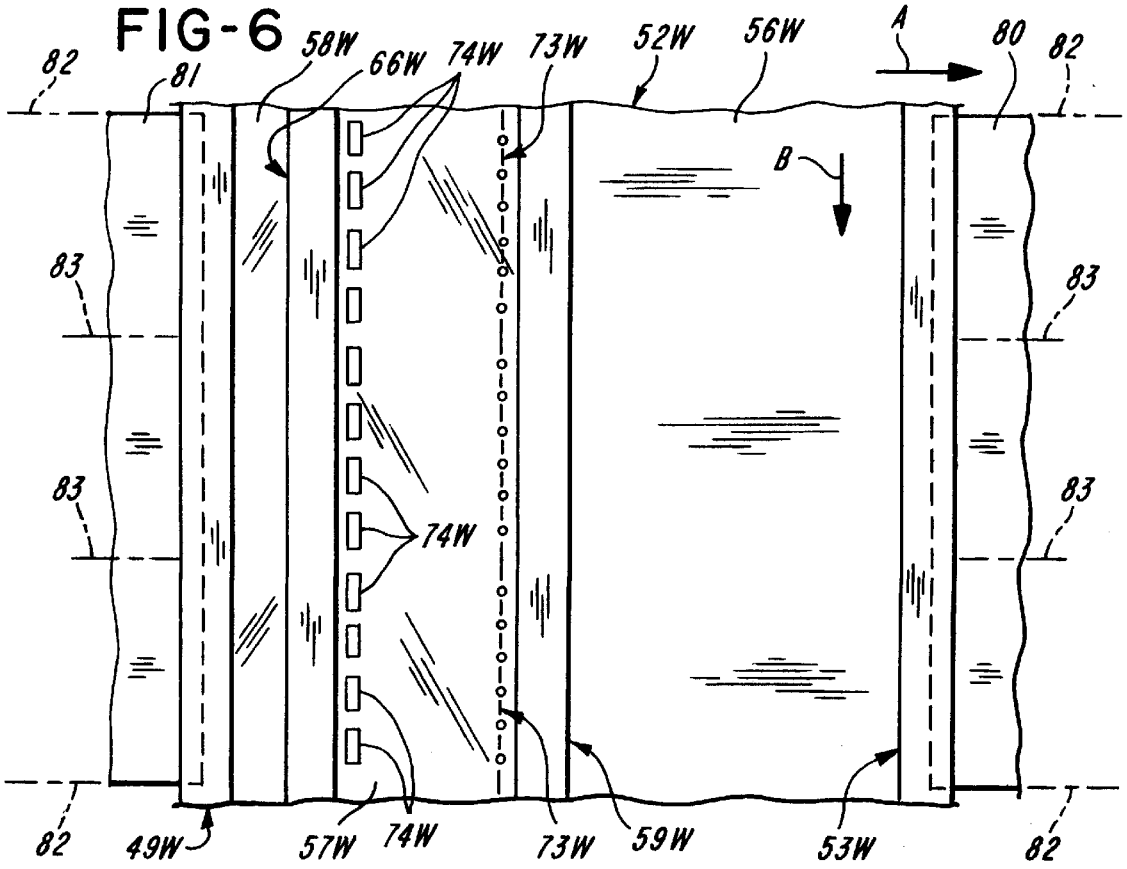
FIG. 6 is a top plan view showing a composite leader connecting two wide webs.

In the manufacture of a package 40, the ink ribbon is advanced from the ink ribbon production equipment to a leader-trailer bed (not shown) in the direction of arrow A in FIG. 6. While in the leader-trailer bed, the ink ribbon is slit transversely into wide webs 80 and 81 and the wide web 80 is advanced in the direction of the arrow A while the wide web 81 remains stationary. Next, a composite leader web 52W corresponding to the leader portion 52' is advanced in the direction of arrow B, but at a level above the plane of the webs 80 and 81. The composite leader web 52W is wider than the distance between the wide webs 80 and 81. The composite leader web 52W has leader strips 56W, 57W and 58W corresponding to leader strips 56, 57 and 58 and has pressure sensitive adhesive tape or strips 53W, 59W and 66W corresponding to the tape or strips 53, 59 and 66. The adhesive tape strip 49W is attached to the tab strip 58W and to the wide ink ribbon web 81. Next the leader web 52W is trimmed by slitting along lines 82 and 83 which run along the side edges of the webs 80 and 81. Thus, the webs 80 and 81 are connected by a leader web 52W for advancement to a rewinder diagrammatically illustrated in FIGS. 7 and 8. As the webs 80 and 81 and the intervening leader web 52W are advanced, slitting knives (not shown) slit the webs 80 and 81 and the web 52W along lines 83 into, for example, three narrow webs such as the web 46.

Figure 7:
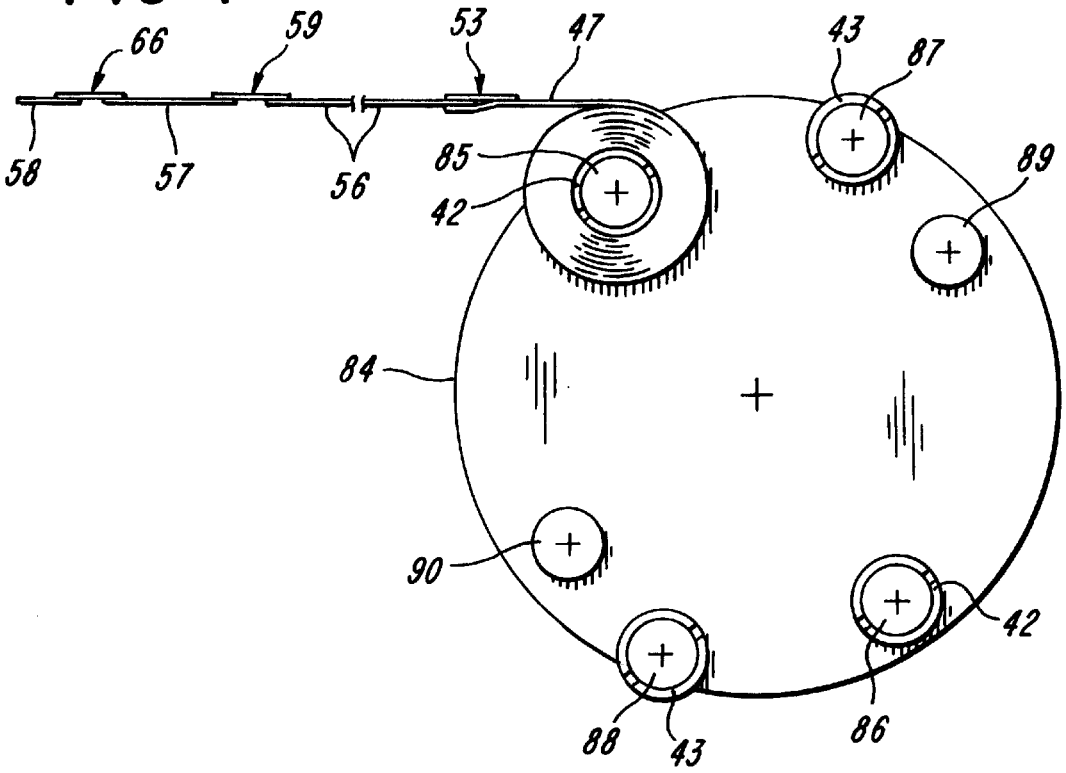
FIG. 7 is a diagrammatic view of a turret rewinder useful for practicing the invention, showing an ink ribbon as having been wound on a supply core.
Figure 8:
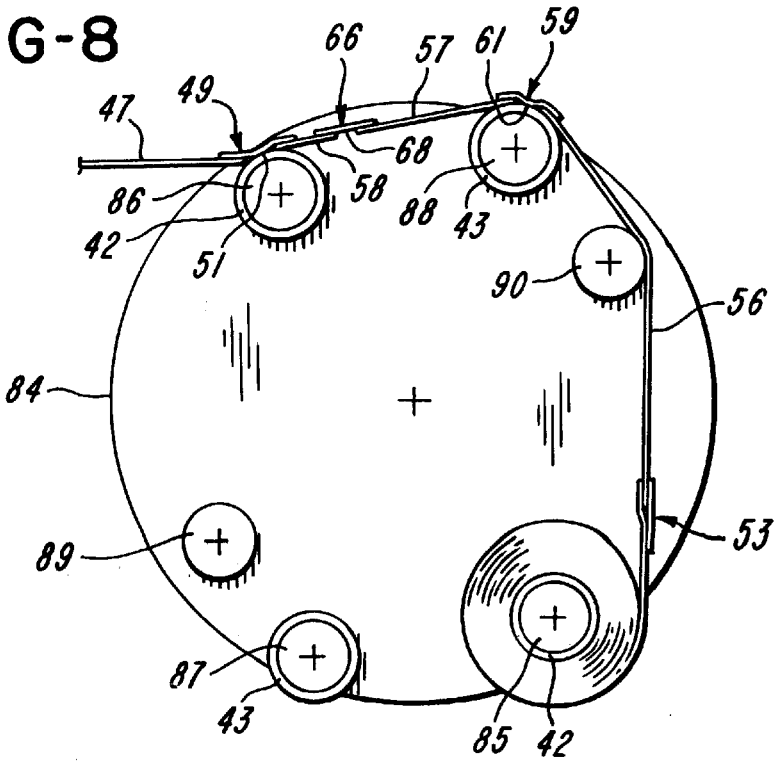
FIG. 8 is a view similar to FIG. 7, but showing the rewinder as having been indexed to a position where the take-up core is attached to the web and the next web is ready to be wound onto the next supply core.

With reference to FIGS. 7 and 8, the rewinder 84 can rewind the three narrow webs. The rewinder 84 has two opposed turrets 85 and 86 on which supply cores 42 can be mounted. Each turret 85 and 86 also has opposed pairs of holders 87 and 88 on which take-up cores 43 can be mounted. The rewinder 84 also has opposed edge guides 89 and 90.

With reference to FIG. 7, the rewinder 84 is shown in a position in which the ink ribbon 47 is almost entirely wound onto the core 42 on the turret 86. The turret 84 is now indexed clockwise into the FIG. 8 position at which the exposed stripe of adhesive 61 on the tape 59 is against and in contact with the outer periphery of the take-up core 43. The machine operator now lightly presses the tape 59 against the take-up core 43 to better adhere the adhesive 61 to the take-up core 43. Next the operator presses the tape 49 against the core 42 so that the adhesive 51 adheres permanently against the core 42. The operator then peels the tape 49 from the leader strip 58 and presses the remainder of the tape 49 against the core 42. The operator now removes the take-up core 43 from the turret and between edge guides 90, takes up any slack by winding the leader portion 52' around the ink ribbon roll 41 (shown at the bottom of FIG. 8), and adheres the exposed stripe of adhesive 68 of the tape 66 to the outer surface of the web 46. Although the adhesive 68 is adhered to the outer surface of the roll 41 it can be attached anyplace on the outer wrap. The now-completed package 41 is slipped off the turret 85, and the same process can proceed for the next ink ribbon.

Figure 9:
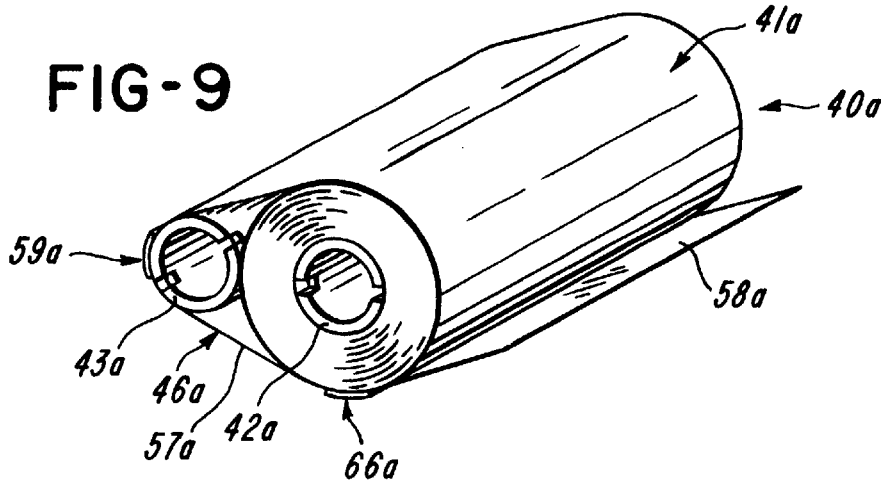
FIG. 9 is a perspective view of a package of the embodiment of FIGS. 9 through 11.
Figure 10:
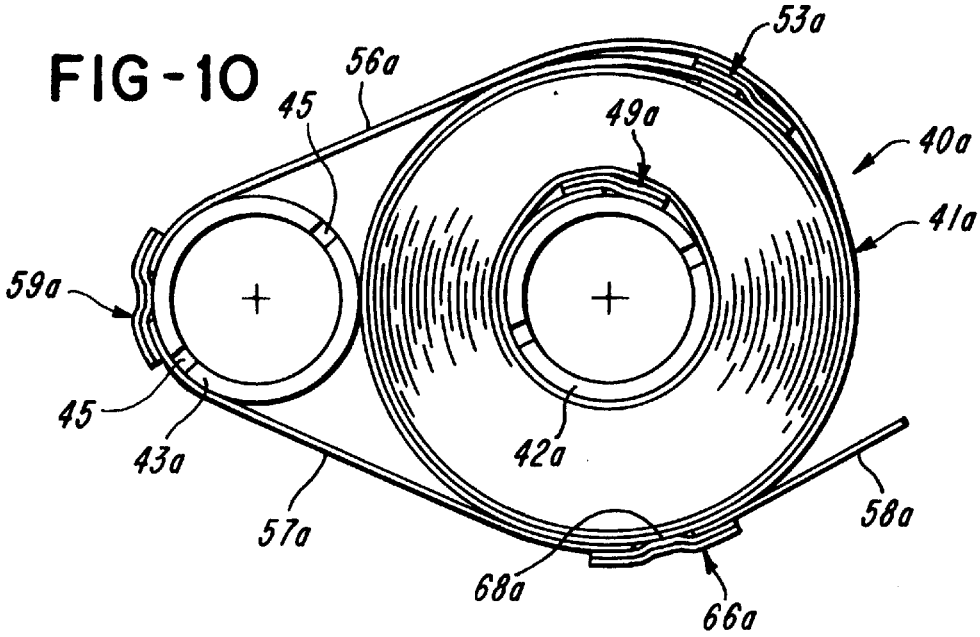
FIG. 10 is a side elevational view of the package.
Figure 11:
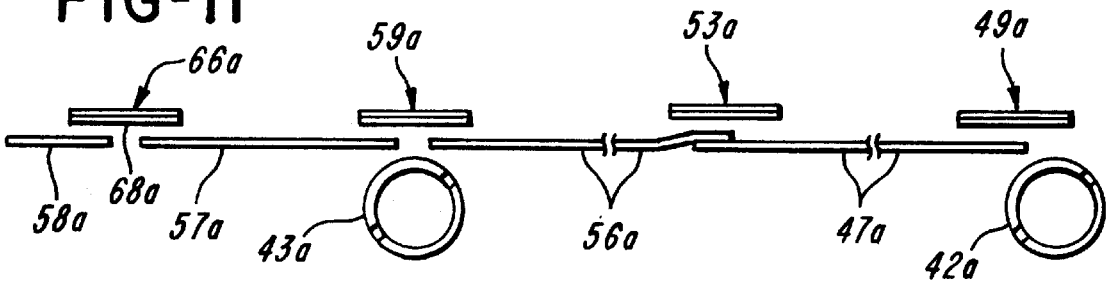
FIG. 11 is a developed, exploded, fragmentary, side elevational view of the web and the supply and take-up cores.

In the embodiment of FIGS. 9 through 11, the same reference characters are used as in the embodiment of FIGS. 1 through 8 for components having the same structure, function and relative location, with the addition of the letter "a". The package 40*a* differs from the package 40 only in that there is no line of weakening such as the line of weakening 73 of the package 46. The manner of use of the package 40*a* differs from that of the package 40 in that after the user pulls on the tab 58*a* to unstick the adhesive 68*a* of the tape 66*a* from the outer surface of the roll 41*a*, the leader strip 57*a* and the tab strip 58*a* can simply be wrapped up about the take-up core 42 as after the take-up core 42 and the supply core 44*a* are installed in the printer.

Figure 12:
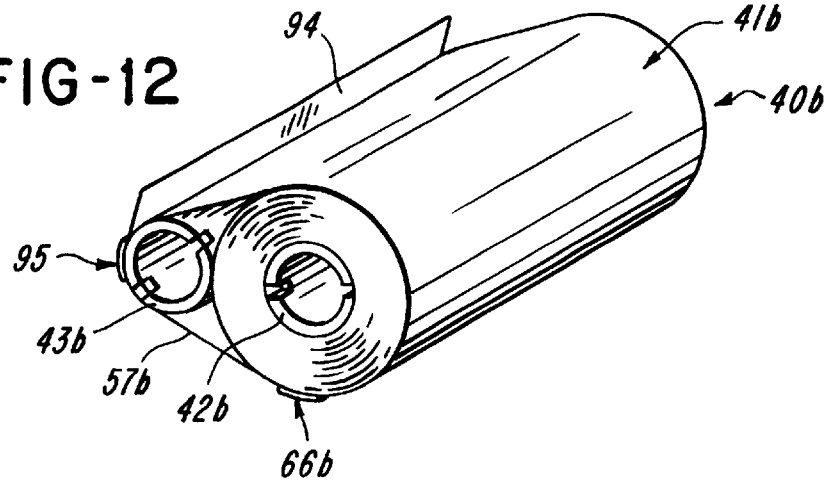
FIG. 12 is a perspective view of a package in accordance with the embodiment of FIGS. 12 through 14.
Figure 13:
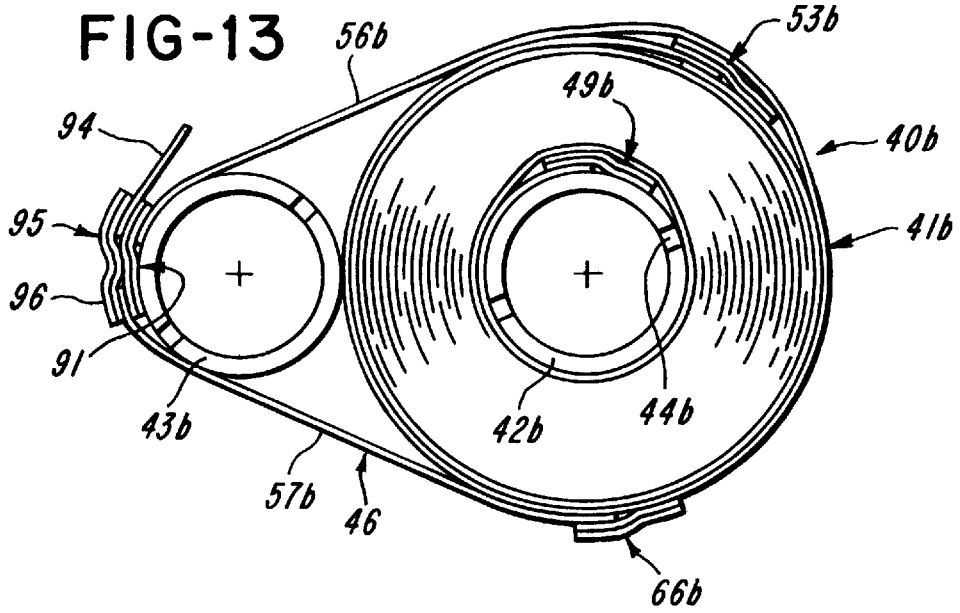
FIG. 13 is a side elevational view of the package.
Figure 14:
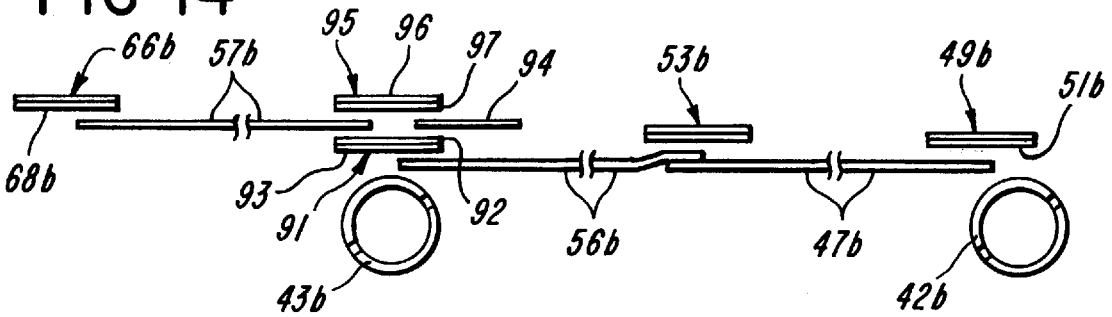
FIG. 14 is a developed, exploded, fragmentary, side elevational view of the web and the supply and take-up cores.

In the embodiment of FIGS. 12 through 14, the same reference characters are used as in the embodiment of FIGS. 1 through 8 for components having the same structure, function and relative location, with the addition of the letter "b". The package 40*b* differs from the package 40, as follows: The leader strip 56*b* is permanently secured to the core 43*b* by a transversely extending strip of adhesive tape generally indicated at 91. The tape 91 is comprised of flexible plastics film 92 with a coating of permanent pressure sensitive adhesive 93. A portion of the width of the tape 91 is adhered to the leader strip 56*b* and the remainder is adhered to the take-up core 43*b*. A marginal end of a transversely extending strip or tab 94 is spaced from the leader strip 57*b*. A transversely extending strip of pressure sensitive tape 95 spans across the respective marginal ends of the tab strip 94 and the leader strip 57. The tape 95 comprises film 96 and a coating of permanent pressure sensitive adhesive 97. The adhesive 97 is releasably adhered to the tape 91. As best shown in FIG. 13, the tape 66*b* releasably adheres the leader strip 57*b* to the outer surface of the web 46*b* at the roll 41*b*. When it is desired to unwrap the package 40*b*, the user pulls the tab 94 and separates the tape 95 from the tape 91. By continuing to pull on the tab 94 the user pulls the tape 66*b* loose from the outer surface of the web 46*b*. The user can then discard the leader strip 57*b* the tapes 66*b* and 95 and the tab 94 as a unit.

Figure 15:
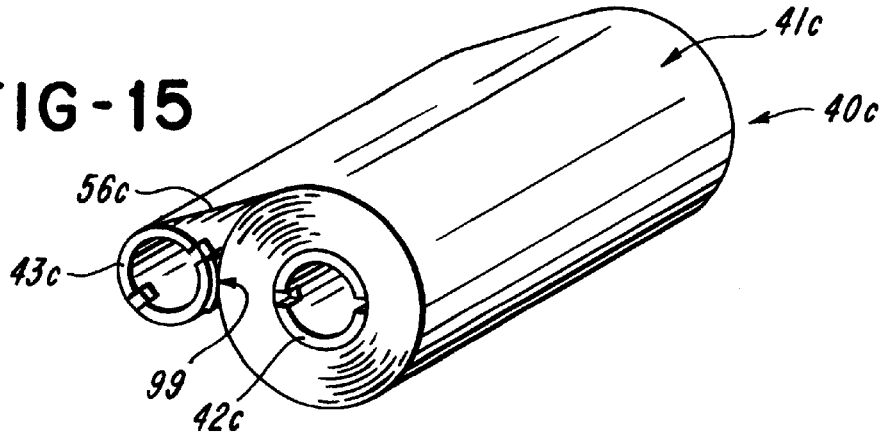
FIG. 15 is a perspective view of a package in accordance with the embodiment of FIGS. 15 through 17.
Figure 16:
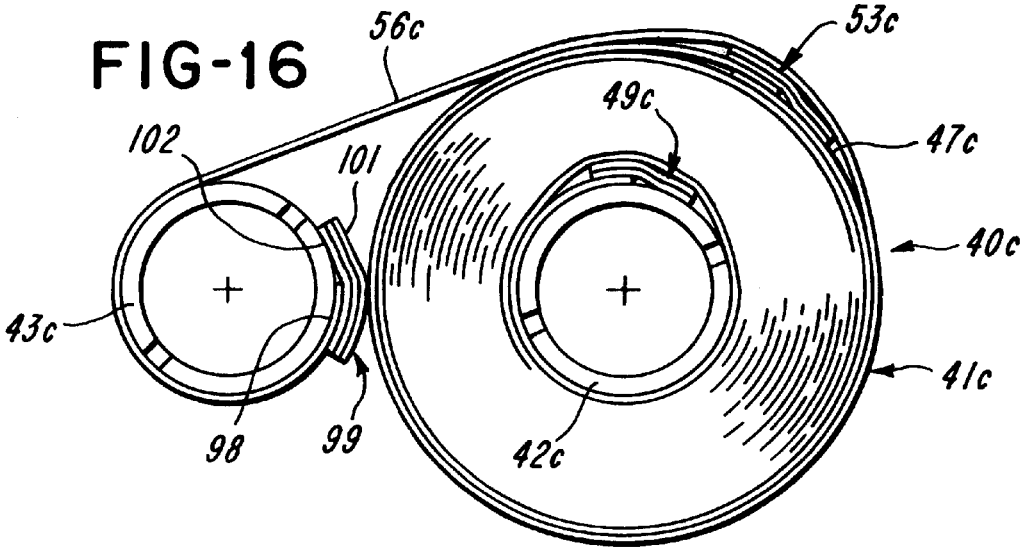
FIG. 16 is a side elevational view of the package.
Figure 17:
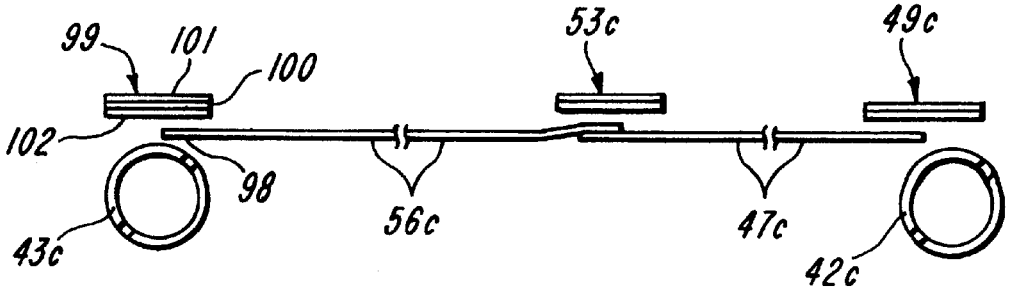
FIG. 17 is a developed, exploded, fragmentary, side elevational view of the web and the supply and take-up cores.

In the embodiment of FIGS. 15 through 17, the same reference characters are used as in the embodiment of FIGS. 1 through 8 for components having the same structure, function and relative location, with the addition of the letter "c". The leader strip 56*c* is shown to have a marginal end 98 located between a transversely extending transverse strip of double-faced adhesive tape generally indicated at 99 and the take-up core 43*c*. The tape 99 is comprised of a flexible plastics film 100 with a coating of permanent adhesive 101 on one side and a coating of permanent adhesive 102 on the other side. The tape 99 overlays the marginal end 98 and the outer periphery of the take-up roll 43*c* as best shown in FIG. 16. The adhesive 101 is releasably adhered to the outer surface of the roll 41*c*. In order to unwrap the package, the user simply grips the outside of the roll 41*c* and the outside of the take-up core 42*c* and pulls the adhesive 101 free from the outer surface of the roll 41*c*. The tape 99 stays with the take-up core 43*c* as the ink ribbon 47 is used in the printer.

Figure 18:
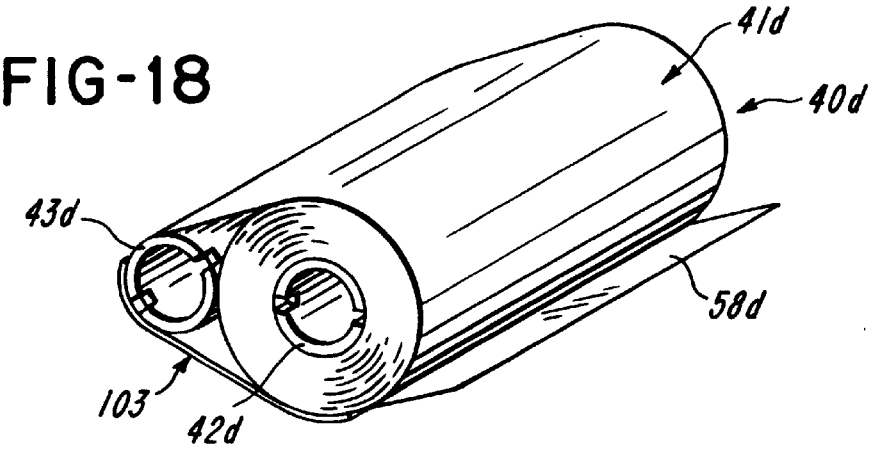
FIG. 18 is a perspective view of a package in accordance with the embodiment of FIGS. 18 through 20.
Figure 19:
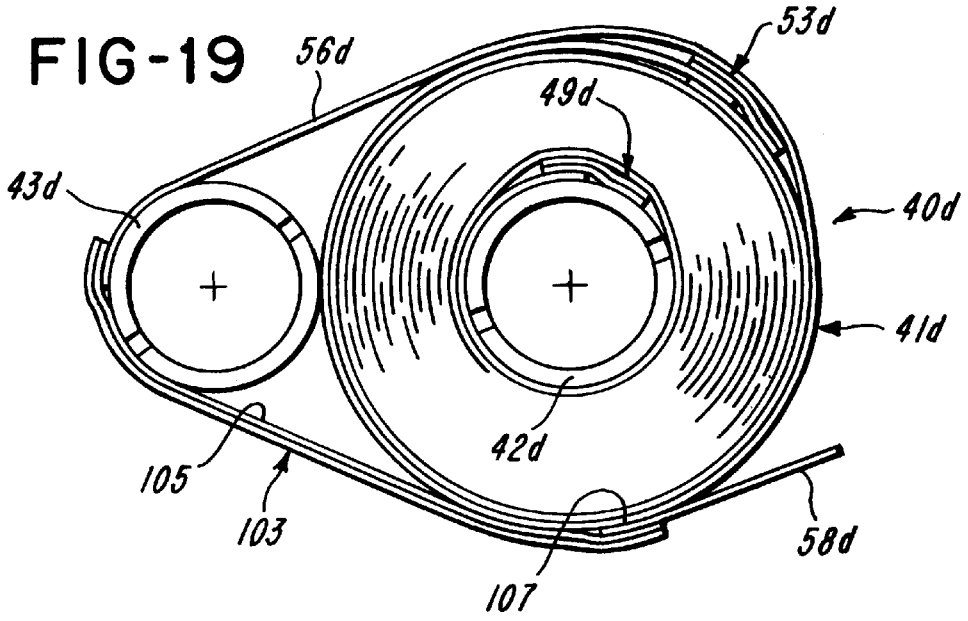
FIG. 19 is a side elevational view of the package.
Figure 20:
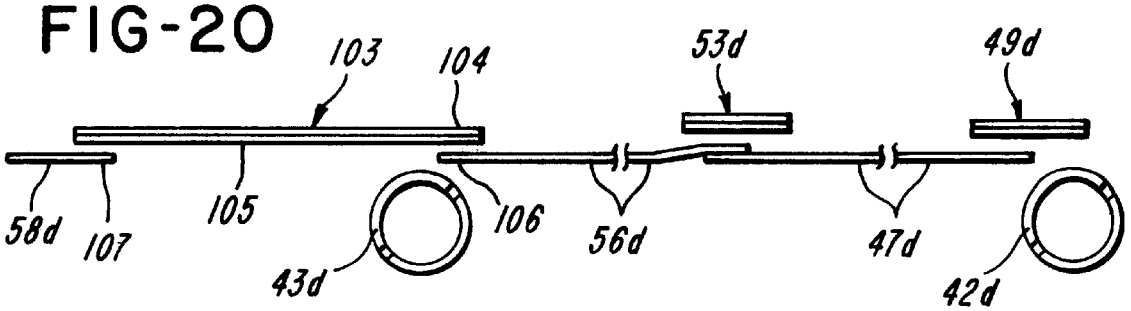
FIG. 20 is a developed, exploded, fragmentary, side elevational view of the web and the supply and take-up cores.

In the embodiment of FIGS. 18 through 20, the same reference characters are used as in the embodiment of FIGS. 1 through 8 for components having the same structure, function and relative location, with the addition of the letter "d". The package 40*d* includes a transversely extending strip of tape generally indicated at 103 comprising a plastics film 104 having a coating of permanent adhesive 105. The tape 103 is adhered to a marginal end 106 of the leader strip 56*d*, to the outer periphery of the take-up core 43*d*, to marginal end 107 of the tab 58*d* and to the other surface of the roll 41*d* as best shown in FIG. 19. To unwrap the package 40*d*, the user pulls on the tab 58*d* and separates the tape 103 from the outer surface of the roll 41*d*. In use, the tape 103 and the tab 58*d* thereon can be wound around the take-up core 42*d* as the ink ribbon 47*d* is being used in the printer.

It is evident that in the embodiments of FIGS. 1 through 20 to the take-up core is within or is enclosed by the portion of the web that forms the wrapper. In these embodiments, by way of example not limitation, the main web portion 52 is about 200 meters in length and the leader portion 52' is about 0.5 meter in length.

In the embodiments of FIGS. 21 through 34 the take-up core is on the outside of the portion of the web that is attached to the outer surface of the roll. In these embodiments, by way of example not limitation, the main web portion 52 is about 200 meters in length and the leader portion 52' is about 0.35 meter in length.

Figure 21:
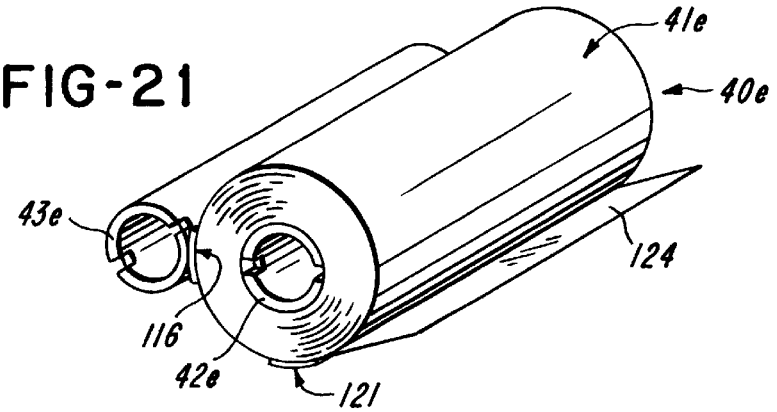
FIG. 21 is a perspective view of a package in accordance with the embodiment of FIGS. 21 through 25.
Figure 22:
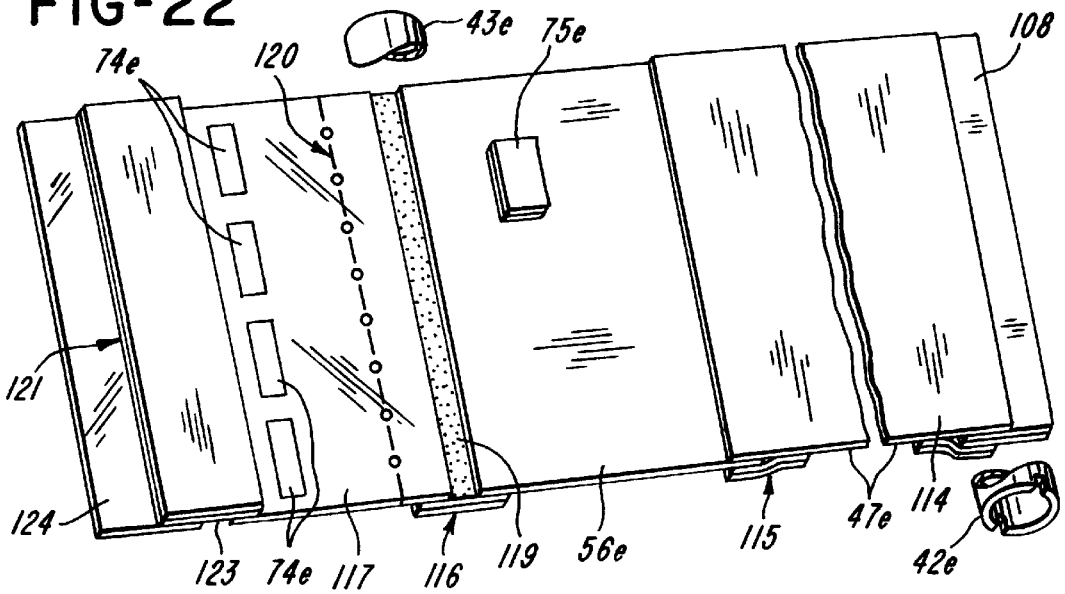
FIG. 22 is a developed, exploded, perspective view showing fragmentary portions of the web and the supply and take-up cores.
Figure 23:
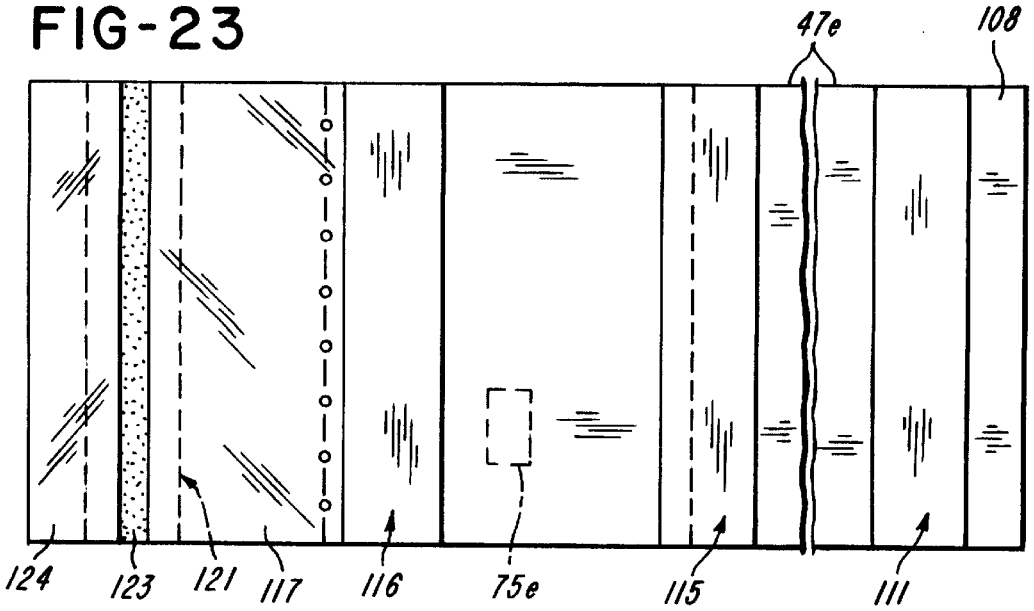
FIG. 23 is a bottom plan view of the web.
Figure 24:
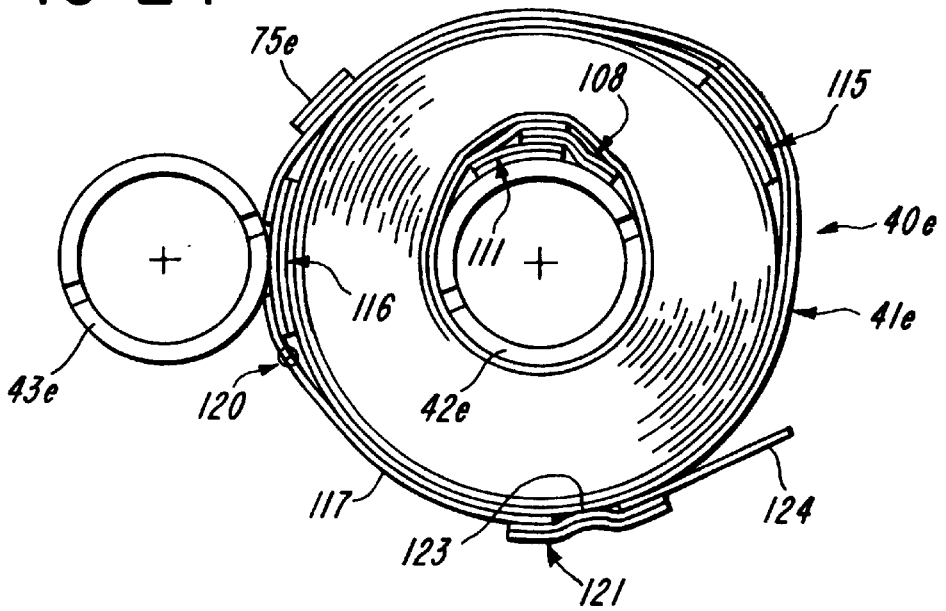
FIG. 24 is a side elevational view of the package.
Figure 25:
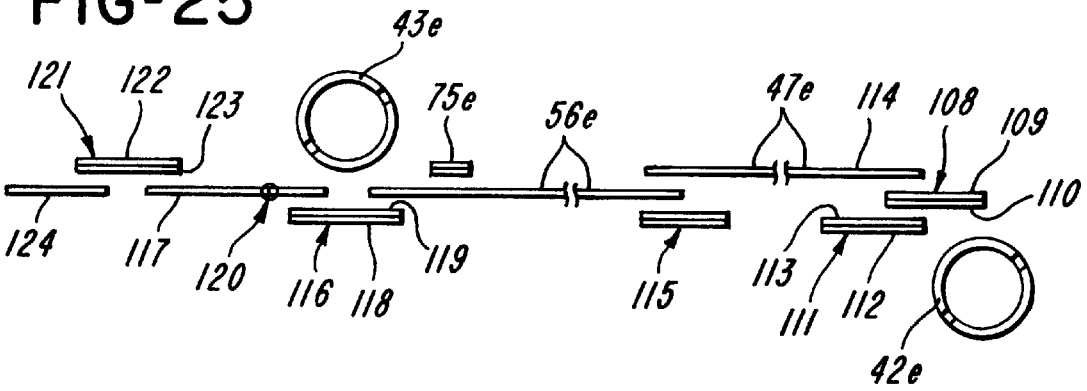
FIG. 25 is a developed, exploded, fragmentary, side elevational view of the package.

With reference to the embodiment of FIGS. 21 through 25, there is shown a transversely extending strip of adhesive tape generally indicated at 108 having a plastics film 109 and a coating of permanent pressure sensitive adhesive 110. There is also a transversely extending strip of adhesive tape generally indicated at 111 having a plastics film 112 and a coating of permanent pressure sensitive adhesive 113. The tapes 108 and 111 partially overlap each other as best shown in FIGS. 22, 24 and 25. The tape 111 is adhered to end portion 114 of the ink ribbon 47*e* and to the adhesive 110 on the tape 108. The adhesive 110 is adhered to the outer surface of the supply core 42*e*. A strip of adhesive tape generally indicated at 115 connects the ink ribbon 47*e* to a leader or leader strip 56*e*. A strip of adhesive tape generally indicated at 116 connects the leader strip 56*e* to a leader strip 117. The leader strips 56*e* and 117 are spaced apart and the adhesive tape 116 spans across and connects marginal ends of the leader strips 56*e* and 117. The strip of tape 116 includes a film 118 and a coating of permanent pressure sensitive adhesive 119. The adhesive 119 is permanently adhered to the take-up core 43*e*. The leader 117 is shown to have a transversely extending line of weakening generally indicated at 120. A transversely extending pressure sensitive tape generally indicated at 121 includes a plastics film 122 and a coating of permanent pressure sensitive adhesive 123. The tape 121 connects the leader strip 117 and a transversely extending leader strip or tab 124. The leader strip 117 and the tab 124 are spaced apart so that there is a stripe of exposed adhesive 123 as best shown in FIG. 23. The adhesive 123 is used to adhere the tape 121 to the outer surface of the roll 41*e* as best shown in FIGS. 21 and 24. When it is desired to unwrap the package 40*e*, the user pulls on the tab 124 and pulls the tape 123 from the outer surface of the roll 41*e*. Next, the user can tear the leader strip 117 at the line of weakening 120. The ink ribbon is now ready to be used in the printer or other device.

Figure 26:
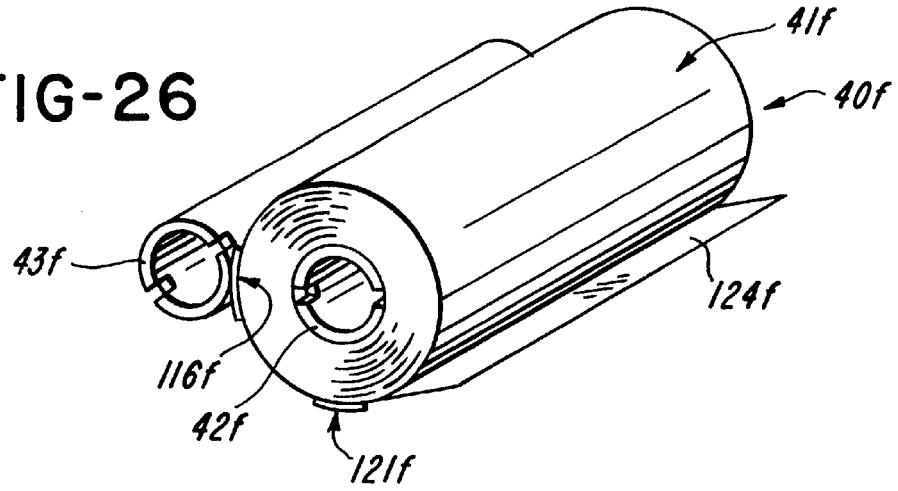
FIG. 26 is a perspective view of a package in accordance with the embodiment of FIGS. 26 through 28.
Figure 27:
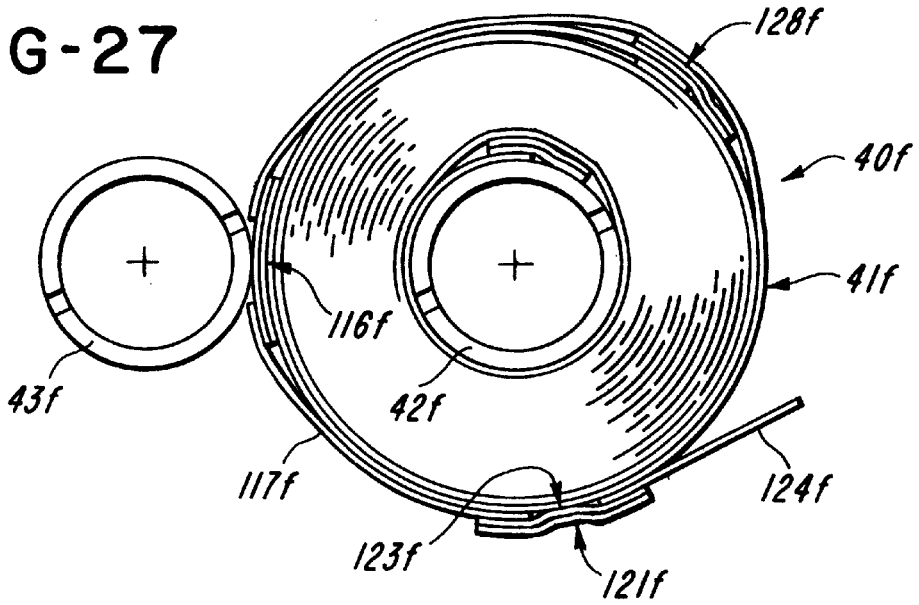
FIG. 27 is a side elevational view of the package.
Figure 28:
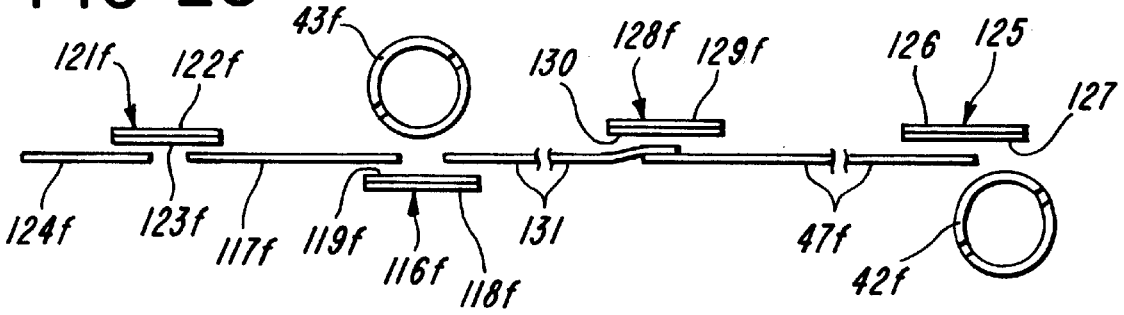
FIG. 28 is a developed, exploded, fragmentary, side elevational view of the web and the supply and take-up cores.

The package 40*f* of the embodiment of FIGS. 26 through 28 is identical to the embodiment of FIGS. 21 through 25 except that there is no line of weakening as in the embodiment of FIGS. 21 through 25 and except as noted hereafter. Accordingly, the same reference characters are used for components having the same structure, function and relative location with the addition of the letter "f". The package 40*f* includes the roll 41*f*. A transversely extending strip of tape 125 has a flexible film 126 and a coating of permanent pressure sensitive adhesive 127. The adhesive 127 connects the ink ribbon 47*f* to the supply core 42*f*. A transversely extending strip of pressure sensitive adhesive tape 128 includes a flexible plastics film 129 and a coating of permanent pressure sensitive adhesive 130 adhered to the overlapped marginal ends of the ink ribbon 47*f* and a transversely extending leader strip 131. The leader strip 131 adheres to the permanent pressure sensitive adhesive 119*f* on the tape 116*f*. To unwrap the package, the user pulls on the tab 124*f* and loosens the tape 121*f* from the outer surface of the roll 41*f*. The leader strip 117*f*, the tape 121*f* and the tab 124*f* as a unit can be wound onto the take-up core 42*f* while the ink ribbon 47*f* is being used in the printer or other device.

Figure 29:
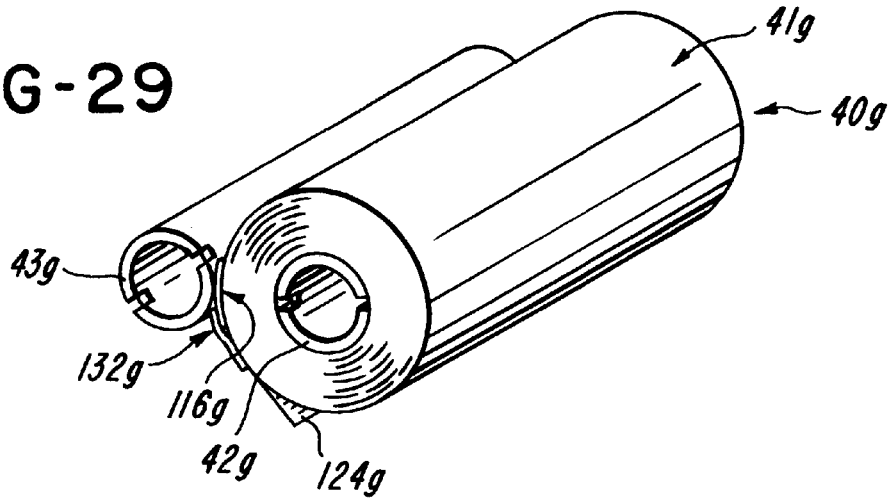
FIG. 29 is a perspective view of a package in accordance with the embodiment of FIGS. 29 through 31.
Figure 30:
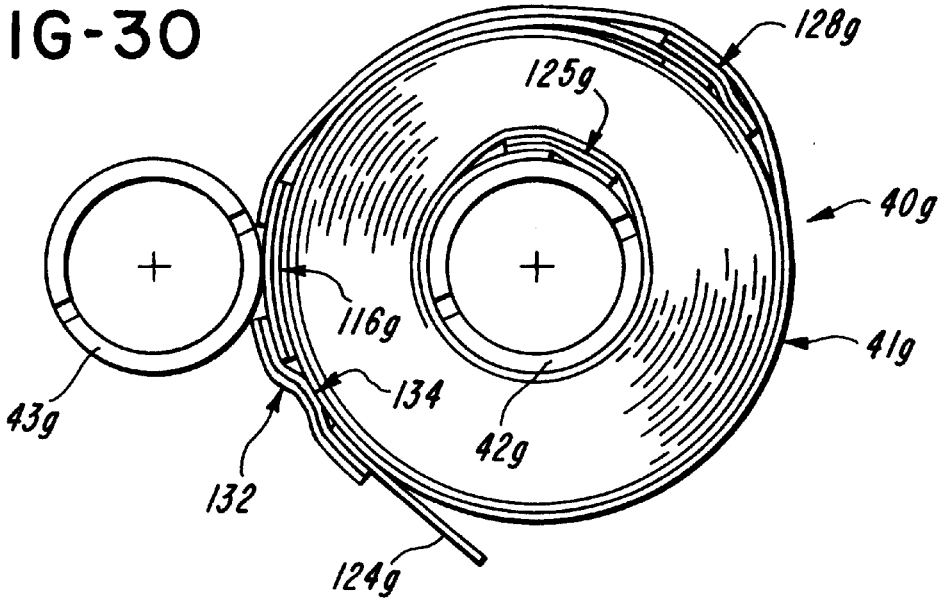
FIG. 30 is a side elevational view of the package.
Figure 31:
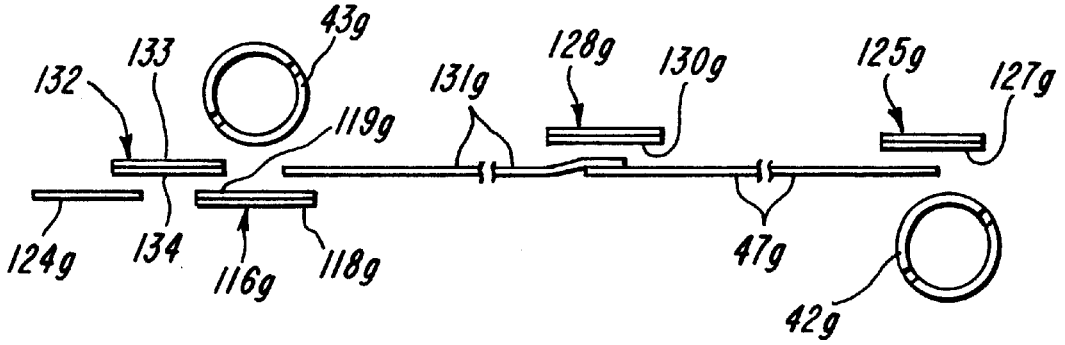
FIG. 31 is a developed, exploded, fragmentary, side elevational view of the web and the supply and take-up cores.

Except as noted, the embodiment of FIGS. 29 through 31 is the same as the embodiment of FIGS. 26 through 28 so that the components having the same structure, function and relative location use the same reference characters with the addition of the letter "g". The package 40*g* omits the leader strip 117*f* and adheres a transversely extending strip of tape 132 to the tape 116*g*. The tape 132 has a plastics film 133 and a coating of permanent pressure sensitive adhesive 134. The adhesive 134 adheres to the adhesive 119*g* on the tape 116*g* and to the tab 124*g*. The adhesive 119*g* also adheres to the outer periphery of the take-up core 43*g*. FIG. 30 shows the adhesive 134 on the tape 132 is adhered to the outer surface of the and to the leader 131*g*. To unwrap the package 40*g*, the user pulls on the tab 124*g* which pulls the tape 132 from the surface of the roll 41*g*.

Figure 32:
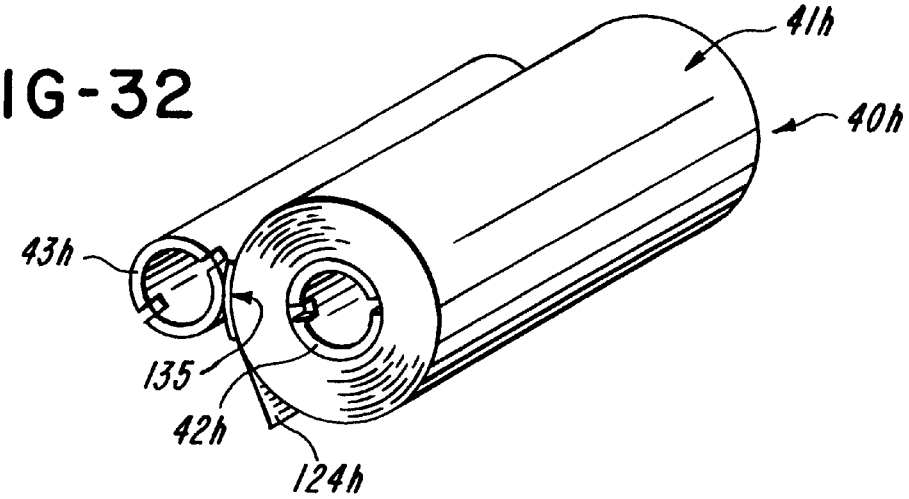
FIG. 32 is a perspective view of a package in accordance with the embodiment of FIGS. 32 through 34.
Figure 33:
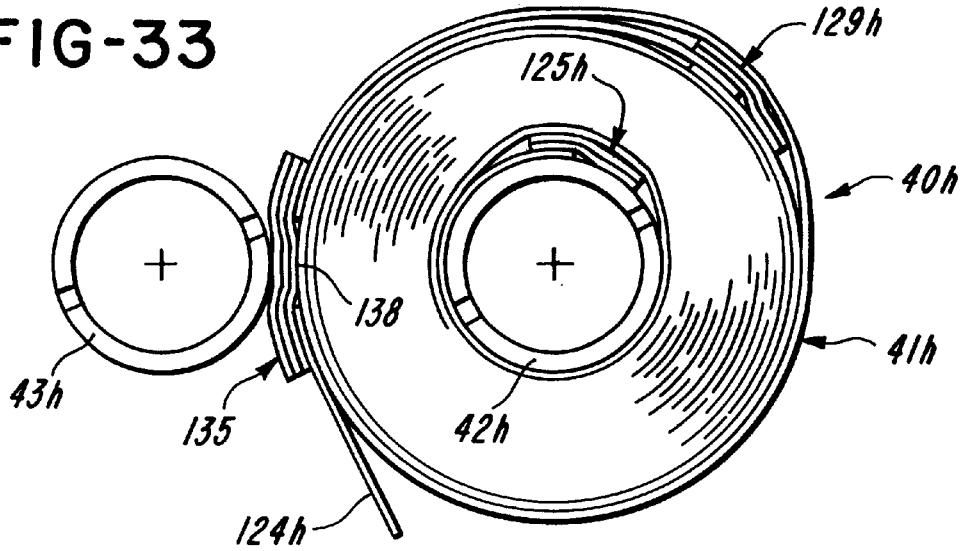
FIG. 33 is a side elevational view of the package.
Figure 34:
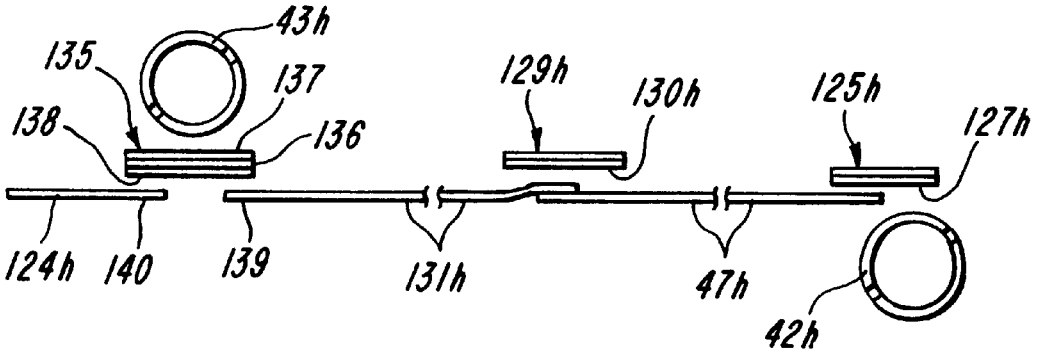
FIG. 34 is a developed, exploded, fragmentary, side elevational view of the web and the supply and take-up cores.

The package 40*h* of the embodiment of FIGS. 32 through 34 is identical to the embodiment of FIGS. 29 through 31 except as noted hereafter. Accordingly, the same reference characters are used with the addition of the letter "h" for components having the same structure, function and relative location. The package 40*h* includes a transversely extending strip of double-faced pressure sensitive adhesive tape generally indicated at 135 having a flexible plastics film 136 with a coating of permanent pressure sensitive adhesive 137 on one side and a coating of permanent pressure sensitive adhesive 138 on the other side. The adhesive 137 adheres to the outer periphery of the take-up core 43*h* and the adhesive 138 adheres to a marginal end 139 of the leader strip 131*h* and to a marginal end 140 of the tab or leader strip 124*h*. The marginal ends 139 and 140 are spaced apart leaving some adhesive 138 exposed. As best shown in FIG. 33, the adhesive 138 is adhered to the outer surface of the roll 41*h*. When it is desired to unwrap the package 40*h*, the user pulls on the tab 124*h* and loosens the adhesive 138 from the surface to which it is adhered.

In the case of an ink ribbon in the various embodiments, the ink ribbon 47 through 47*h* is comprised of a flexible plastics film onto which ink has been coated. The film is for example polyethylene. The adhesives used in the various embodiments are made with adequate aggressiveness to serve their intended function.

The invention is not limited to ink ribbons unless an ink ribbon is recited in a particular claim. Rather the invention is useful with various types of webs.

Unless otherwise indicated, the particular order of the steps recited in the appended claims is not critical; the particular order of steps can be changed without departing from the spirit of the invention.

Other embodiments and modifications of the invention will suggest themselves to those skilled in the art, and all such of these as come within the spirit of this invention are included within its scope as best defined by the appended claims.

What is claimed is:

1. A package, comprising: a take-up core; and a web including an ink ribbon portion and a composite leader portion, the composite leader portion including first, second and third leader strips, the ink ribbon portion being wound into a roll and the leader portion extending beyond the roll, a first transversely extending adhesive tape connecting the ink ribbon portion and the first leader strip, the first and second leader strips having spaced respective first marginal ends, a second transversely extending adhesive tape connecting the first and second marginal ends and adhered to the take-up core, the second and third leader strips having spaced respective second marginal ends, and a third transversely extending adhesive tape connecting the second marginal ends and adhered to the outer surface of the web, and the third leader strip being free and manually graspable.

2. A package as defined in claim 1, including a transversely extending line of weakening in the second leader strip.

3. A package, comprising: a web including an ink ribbon portion and a composite leader portion, a take-up core, the web being wound into a roll and the leader portion projecting beyond the roll, the leader portion having first and second spaced leader strips, first and second strips of adhesive tape, the first strip of adhesive tape being adhesively adhered to the first leader strip, to the take-up core and to the second strip of adhesive tape, and the second strip of adhesive tape being adhesively adhered to the outer surface of the web and to the second leader strip.

4. A package, comprising: a web including an ink ribbon portion and a composite leader portion, the composite leader portion including a leader strip, a transversely extending strip of adhesive tape and a manually graspable tab, the leader portion being secured to the ink ribbon portion, the ink ribbon portion being wound into a roll and the leader portion extending beyond the roll, the leader strip and the tab having spaced marginal ends, the adhesive tape connecting the marginal ends and adhered to both the take-up core and the roll.

5. A package, comprising: a take-up core, a web having a coating over at least most of its length and wound into a roll and having an outer portion extending beyond of the outer surface of the roll and attached to the take-up core, the outer portion extending beyond the place of attachment to the take-up core, and adhesive between the outer portion and the outer surface of the roll for adhering the outer portion to the outer surface of the roll.

6. A package as defined in claim 5, including a line of weakening in the web between the place of attachment to the take-up core and the adhesive.

7. A package as defined in claim 6, wherein the outer portion has a manually graspable tab.

8. A package as defined in claim 5, wherein the adhesive is a removable adhesive so that the outer portion beyond the place of attachment to the take-up core can be separated from the outer surface of the roll.

9. A package as defined in claim 5, wherein the outer portion beyond the place of attachment to the take-up core includes a manually graspable tab, and the adhesive being adjacent to the tab.

10. Method of making a package, comprising: providing a web including a main web portion and a leader portion having a transversely extending line of weakening, providing a take-up core, winding the main portion into a roll with the leader portion projecting outwardly of the roll, adhering the leader portion to the take-up core, adhering the leader portion to the outer surface of the web, and wherein the line of weakening is disposed between the place where the leader portion is adhered to the take-up core and the place where the leader portion is attached to the outer surface of the web.

11. Method as defined in claim 10, wherein the main portion includes an ink ribbon.

12. Method of making a package, comprising: providing a web including an ink ribbon portion and a leader portion, the leader portion including a transversely extending leader strip, a transversely extending manually graspable tab spaced from the leader strip, and adhesive tape connecting the leader strip and the tab, winding the ink ribbon portion into a roll with the leader portion projecting beyond the roll, providing a take-up core, adhering the leader portion to the take-up core, and adhering the adhesive tape to the outside of the roll.

13. Method of making a package, comprising: providing a web including an ink ribbon portion and a leader portion, winding the ink ribbon portion into a roll with the leader portion projecting outwardly from the roll, the leader portion including at least two leader strips and adhesive tapes connecting the leader strips, providing a take-up core, adhering one of the adhesive tapes to the take-up core, and thereafter adhering another of the adhesive tapes on the outermost leader strip to the outside of the roll.

14. Method of making a package, comprising: providing a turret for holding at least two supply cores and at least two take-up cores, providing a web including an ink ribbon portion and a leader portion, wherein there is adhesive on the leader portion, winding the ink ribbon portion into a roll on a supply core at a ribbon winding position with the leader portion projecting beyond the roll, indexing the turret to bring the other supply core into the ribbon winding position, adhering the leader portion to one of the take-up cores, and adhering the leader portion to the outside of the roll by means of the adhesive.

15. Method of making a package, comprising: feeding a wide ink ribbon web along a path, slitting the wide ink ribbon web transversely into two wide ink ribbon webs, separating the two ink ribbon webs by a predetermined amount, advancing a composite leader transversely at a level above the wide ink ribbon webs, the composite leader being wider than the distance between the wide ink ribbon webs, the composite leader having zones of exposed adhesive, lowering the composite leader so that adhesive on the composite leader adheres to the wide ink ribbon webs and thereby connects the two wide ink ribbon webs, trimming the composite leader along side edges of the connected wide ink ribbon webs, advancing the connected wide ink ribbon webs, slitting the connected wide ink ribbon web and the intervening composite leader into narrow, connected, ink ribbon webs, winding the one ink ribbon into a roll, providing a take-up core, attaching the ink ribbon onto the take-up core using one of the zones of exposed adhesive, and attaching the remainder of leader onto the outer surface of the roll using another zone of exposed adhesive.

16. Method of making a package, comprising: providing a take-up core, providing a web having a coating over at least most of its length, the web being wound into a roll, with an outer portion of the web extending beyond the outer surface of the roll, attaching the take-up core to the outer portion, and thereafter removably attaching the outer portion to itself using adhesive between the outer portion and the outer surface of the roll.

17. Method of unwrapping a package, comprising: providing a package wherein a web has been wound into a roll, wherein an outer portion of the web extends beyond the outer surface of the roll and is attached to a take-up core, wherein the outer portion extends beyond the place of attachment to the take-up core and is removably attached to the outer surface of the roll, and a line of weakening in the web between the place of attachment of the web to the take-up core and the place of attachment of the web to the outer surface, detaching the outer portion of the web from the outer surface of the roll, and separating the web at the line of weakening.

18. A package as defined in claim 17, wherein the web is comprised mainly of ink ribbon.

19. Method of unwrapping a package, comprising: providing a package wherein a web has been wound into a roll, wherein an outer portion of the web extends beyond the outer surface of the roll, wherein adhesive on the outer portion attaches the outer portion to a take-up core and adheres the outer portion to itself, and detaching the outer portion from itself without detaching the take-up core.

20. A package as defined in claim 19, wherein the web is comprised mainly of ink ribbon.

21. Method of unwrapping a package, comprising: providing a package, wherein a web has been wound into a roll, wherein an outer portion of the web extends beyond the outer surface of the roll and is attached to a take-up core, wherein the outer portion extends beyond the place of attachment to the take-up core, wherein the outer portion is attached to itself, and a line of weakening in the web between the place of attachment of the web to the take-up core and the place of attachment of the web to the outer surface, and separating the outer portion at the line of weakening.

22. A package, comprising: a take-up core, a web wound into a roll and having an outer portion extending beyond the outer surface of the roll, wherein the outer portion is permanently transversely attached to the take-up core, wherein the outer portion extends to and is removably adhered to the web by a generally transversely extending stripe of adhesive, and a line of weakening extending generally transversely across the web between the place of attachment to the take-up core and the place of removable adherence to the web.

23. A package as defined in claim 22, including indicia between the line of weakening and the place of adherence to the web.

24. A package, comprising: a web, a take-up core, the web being wound into a supply roll, and the web extending beyond the supply roll, wherein the web is permanently adhered to the take-up core and is removably adhered to the outer surface of the supply roll by adhesive between the web and the supply roll, wherein the web terminates at a manually graspable tab, and a line of weakening in the web between the place of adherence of the web to the take-up core and the place of adherence of the web to the supply roll.

25. A package as defined in claim 24, and indicia on the web beyond the line of weakening.

26. A package, comprising: a take-up core, a web having a coating over at least most of its length and wound into a roll and having an outer portion extending beyond the outer surface of the roll, adhesive on the outer portion attaching the outer portion to the take-up core, additional adhesive on the outer portion releasably attaching the outer portion to itself, and wherein the outer portion is wrapped about the take-up core and the roll.

27. A package as defined in claim 26, wherein the outer portion includes a manually graspable tab for releasing the outer portion at the additional adhesive.

* * * * *